United States Patent [19]

Haeussler

[11] 4,296,909

[45] Oct. 27, 1981

[54] APPARATUS FOR FORMING RECESS AROUND A PICKUP BOLT OF A CONCRETE BODY

[76] Inventor: Ernst Haeussler, Grashofstr. 47, 4300 Essen-Bredeney, Fed. Rep. of Germany

[21] Appl. No.: 183,925

[22] Filed: Sep. 3, 1980

[30] Foreign Application Priority Data

Sep. 5, 1979 [DE] Fed. Rep. of Germany ..... 2935825

[51] Int. Cl.[3] ..... B28B 7/04; B28B 7/30; B28B 7/16

[52] U.S. Cl. ..... 249/94; 52/122; 52/125; 249/95; 249/97; 249/177; 249/178; 249/185; 264/259; 264/233; 294/89; 425/111

[58] Field of Search ..... 249/175, 177, 178, 184, 249/186, 205, 96, 185, 179, 95, 97 X; 294/89, 90; 52/698, 707, 122, 125, 704, 708; 264/333, 259

[56] References Cited

U.S. PATENT DOCUMENTS

| | | | |
|---|---|---|---|
| 822,769 | 6/1906 | Quist | 294/89 |
| 2,748,646 | 6/1956 | Harold et al. | 294/89 |
| 3,499,676 | 3/1970 | Haeussler | 294/90 |
| 3,605,361 | 9/1971 | Howlett et al. | 425/111 |
| 3,632,724 | 1/1972 | Hilgeman | 425/111 |
| 3,676,031 | 7/1972 | Stinton et al. | 425/111 |
| 4,087,947 | 5/1978 | Turner | 52/125 |
| 4,173,367 | 11/1979 | Haeussler | 294/90 |
| 4,179,151 | 12/1979 | Tye | 294/89 |

FOREIGN PATENT DOCUMENTS

| | | | |
|---|---|---|---|
| 1756606 | 4/1970 | Fed. Rep. of Germany | 294/89 |

*Primary Examiner*—W. E. Hoag
*Attorney, Agent, or Firm*—Karl F. Ross

[57] ABSTRACT

In order to form in a concrete body during casting thereof a part-spherical recess around the head of a pickup bolt having a stem embedded in the body, an apparatus is employed comprising a pair of like elements each having an outer surface complementary to a respective half of the inner surface of the recess. These elements are formed with respective halves of a seat that complementarily surrounds the bolt head and the stem in the recess. A bridge is provided with a pair of pivots that define pivot axes for the respective elements, and a manipulating member is rigidly connected to this bridge.

10 Claims, 6 Drawing Figures

FIG. 5
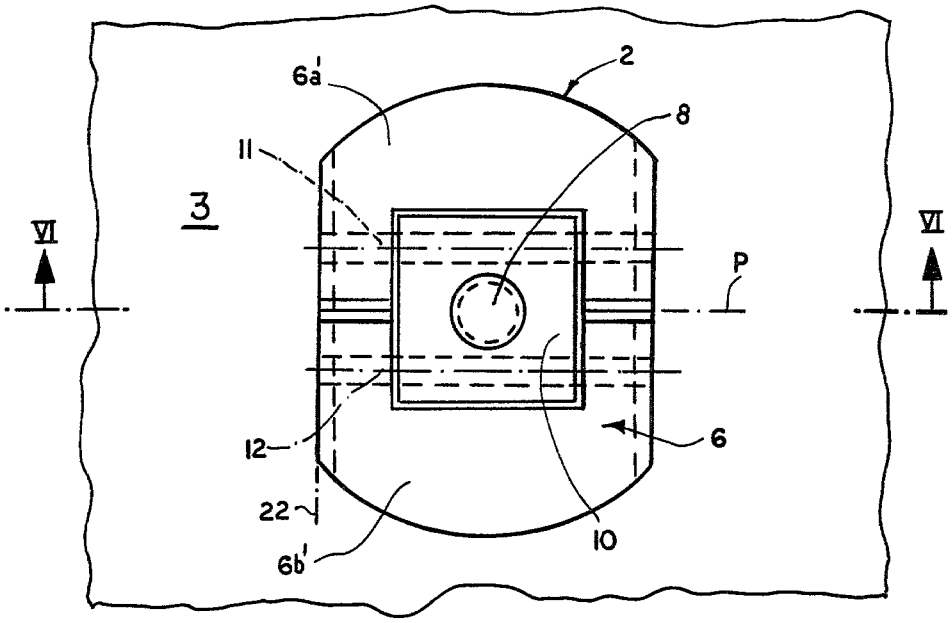
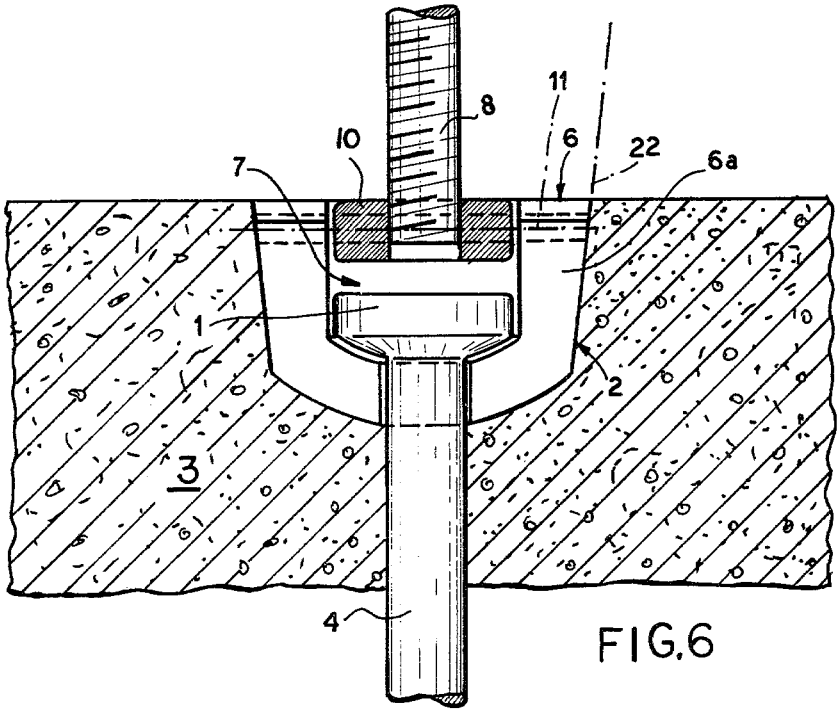
FIG. 6

APPARATUS FOR FORMING RECESS AROUND A PICKUP BOLT OF A CONCRETE BODY

FIELD OF THE INVENTION

The present invention relates to an apparatus for forming in a concrete body during casting thereof a recess around the head of a bolt having a stem embedded in the body. More particularly this invention concerns such an apparatus which forms a part-spherical recess around the head of a pickup bolt of a concrete body.

BACKGROUND OF THE INVENTION

It is known to cast concrete bodies with pickup bolts having stems embedded in the body and heads exposed in part-spherical recesses. Such an arrangement is shown in my earlier U.S. Pat. Nos. 4,173,367 and 3,499,676. A concrete body thus equipped can be relatively easily and safely handled by an appropriate puckup unit. As the head of the pickup bolt is recessed in the concrete body, it in no way interferes with normal handling of the body, and the recess can even be filled once the body is emplaced, if necessary.

Forming the recess around the head of the pickup bolt is a relatively tricky job entailing the use of a special apparatus. The apparatus has a semispherical outer surface formed with a slot that terminates at its center. After sliding a bolt along the slot to the blind end thereof, so that the head of the bolt lies within the apparatus, the slot is closed by an elastic or slidable member. Concrete is then poured around the bolt and apparatus. Once the concrete is hardened the apparatus is slid off the bolt with the stem of the pickup bolt either pushing aside the elastic lips of the slot or the slidable cover of the slot being moved out of the way.

Such devices frequently leak somewhat at the slot. Thus concrete finds its way into the apparatus and makes it extremely difficult, if not impossible, to remove it. Even modest leakage that does not greatly impede removal of the apparatus frequently leaves a concrete lump in the recess which must be removed before a pickup unit can be fitted in the recess over the bolt head.

OBJECTS OF THE INVENTION

It is therefore an object of the present invention to provide an improved apparatus for forming a recess around the head of a pickup body in a concrete body during casting thereof.

Another object is to provide such an apparatus which can easily be removed from the body after the concrete has hardened.

A further object is to provide such an apparatus which can be produced at low cost and which will have a long service life.

SUMMARY OF THE INVENTION

These objects are attained according to the instant invention in an apparatus of the above-described general type having a pair of like elements each having an outer surface complementary to a respective half of the inner surface, defined by a line bisecting the inner surface of the pickup-bolt stem. These elements are formed with respective halves of a seat complementarily surrounding the bolt head and stem in the recess. A bridge is provided with a pair of pivots defining pivot axes parallel to the line and the elements are pivoted on this bridge at these pivot axes. Finally a manipulating member is rigidly connected to the bridge. More particularly the inner surface of the recess is subdivided at a symmetry plane including the bisecting line and itself bisecting the pickup-head bolt and the surface into two identical halves. The elements normally abut at this plane and the pivot axes symmetrically flank the plane.

Pivoting the two elements on the bridge ensures several degrees of freedom of motion of the elements relative to each other. Once the concrete has set first the one element and then the other can be pried loose, leaving a neat semispherical recess in the hardened concrete body.

The elements together form an upwardly open cutout that snugly receives the bolt at its base. The bridge substantially completely covers and blocks this cutout so that concrete cannot enter the cutout. In fact the manipulating member may be a threaded rod threaded into or welded on the bridge. As the bridge and ends have substantially coplanar upper surfaces perpendicular to the symmetry plane it is therefore possible to secure the apparatus to a form, with the pickup-bolt head firmly clenched between the halves. The upper surfaces of the elements are rounded at their abuting faces to permit limited relative motion of the elements to each other. The center of curvature for the rounding of each element is the respective pivot axis.

With the apparatus according to the instant invention it is a relatively easy matter to make the two elements fit together so well that concrete cannot enter between them at the symmetry plane where they abut. Furthermore removing of the apparatus according to this invention from the hardened concrete body is a relatively simple matter since a force exerted on the bridge element to create a torsion about one of the pivot axes will pry up the element of the other pivot axis. Once the one element is loosened a reverse prying on the bridge will loosen the other element. In fact a simple pushing of the rod that normally constitutes the manipulating member, and that normally lies on the plane, to one side to the plane and then back to the other side of the plane will normally completely free the apparatus of the instant invention. What is more this apparatus can readily be made at relatively low cost by forging, normally by the same technique that is used to form the pickup bolt.

BRIEF DESCRIPTION OF THE DRAWING

FIG. 5 is a view similar to FIG. 2 showing another apparatus according to this invention; and FIG. 6 is a section taken along VI—VI of FIG. 5

SPECIFIC DESCRIPTION

Figure 1:
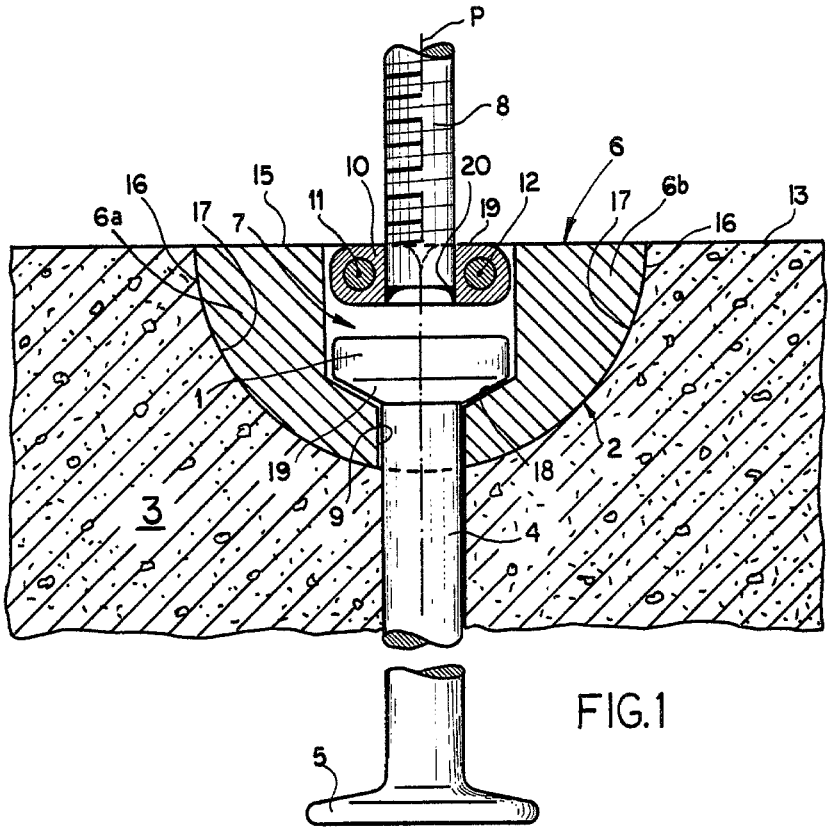
FIG. 1 is a vertical section through a concrete body and an apparatus according to this invention.
Figure 2:
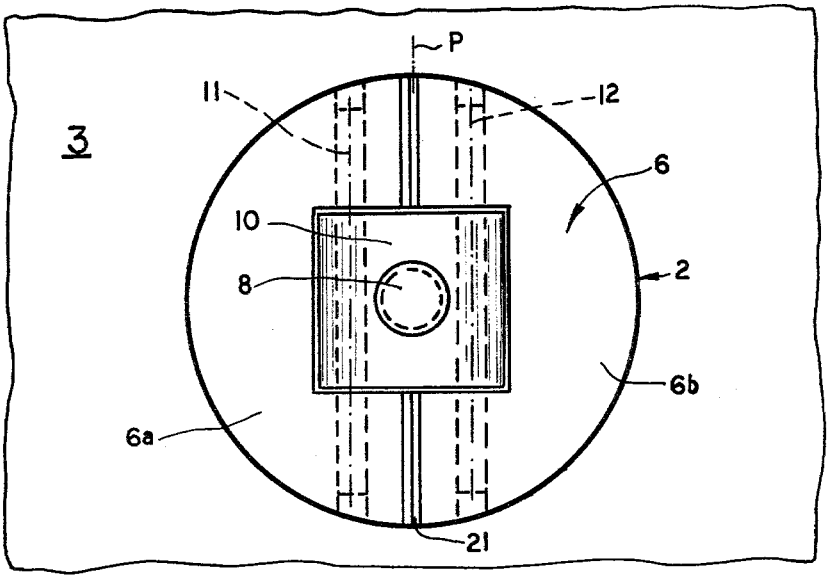
FIG. 2 is a top view of the body and apparatus of FIG. 1.

As seen in FIGS. 1–4 a pickup bolt head 1 is exposed in a semispherical recess 2 in a concrete body 3, with the stem 4 of the bolt extending down to its anchor foot 5. A plane P bisects the head 1 and recess 2. The plane P extends perpendicular to the upper surface 13 of the concrete body 3.

The apparatus 6 for forming the recess 2 basically comprises a pair of quarter-spherical steel elements **6*a* and 6*b* that have faces 14 that abut at the plane P and upper surfaces 15 that normally lie coplanar with the upper surface 13. The elements 6***a* and 6*b* also have quarter-spherical outer surfaces 16 exactly complmentary to the respective halves 17 of the inner surface of the recess 2.

The elements 6*a* and 6*b* are formed at their faces 14 with semicylindrical notches 9 together forming a cylindrical seat or passage that closely surrounds the stem 4 beneath the head 1. Above these seat halves 9 the elements 6*a* and 6*b* together form an upwardly flared frustoconical surface 18 complementary to the corresponding surface 19 underneath the head 1. From there the two elements 6*a* and 6*b* form an upwardly open square cutout 7 each of whose sides is slightly longer than the diameter of the head 1.

A square bridge piece 10 has an upper surface 19 coplanar with the surfaces 13 and 15 and is bisected by the plane P. A pair of pivot pins 11 and 12 parallel to this plane P and symmetrically flanking it are seated in the elements 6*a* and 6*b* to either side of the cutout 7. Thus the elements 6*a* and 6*b* can pivot relative to the bridge piece 10 about the respective pivot pins 11 and 12.

A threaded manipulating rod 8 extending along the plane P coaxially with the stem 4 may be screwed into the bridge 10 as shown in FIGS. 5 and 6 or secured therein by means of welds 20 as shown in FIGS. 1–4.

Figure 3:
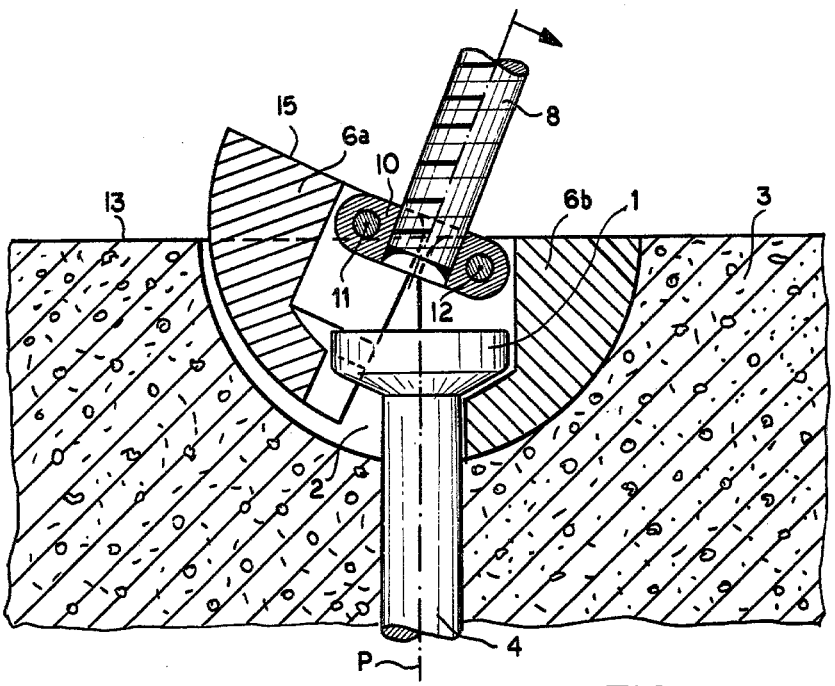
FIGS. 3 and 4 are views similar to FIG. 1 showing use of the apparatus according to the instant invention.
Figure 4:
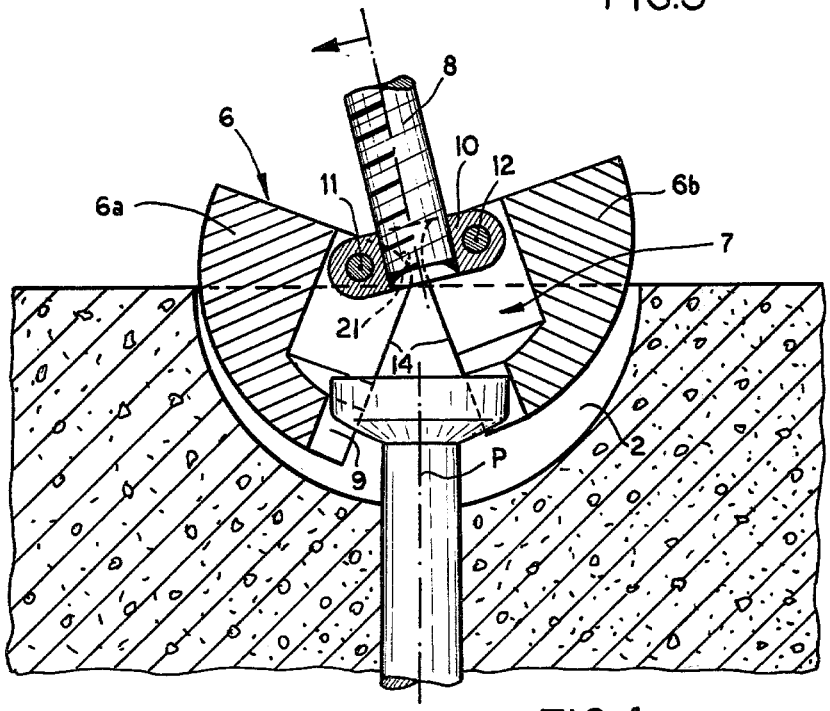

The two elements 6*a* and 6*b* are rounded at 21 at the upper edges of their faces 14 on centers of curvature at the pivot axes defined by the respective pins 11 and 12. This permits the two elements to rock about the respective pivot axes relative to each other as shown in FIGS. 3 and 4. In addition some play is provided around the stem 4 and around the bolt head 1 to allow easy freeing of the device.

Normally the apparatus 6, while clenching a bolt head 1, is simply positioned by passing its manipulating rod 8 through an appropriate hole in the form for the body 3 and fitting a nut over it. This force surfaces 15 and 19 to be coplanar so that the surfaces 14 will also abut each other snugly. In this position concrete can be poured without any fear of it entering the cutout 7, as even if concrete can come on top of the surfaces 15 or 19, the bridge 10 effectively blocks the top of this cutout 7.

After the concrete has hardened and the form has been removed the user need merely rock the member 8 from the plane P toward the element 6*b*, for example, so as to pry up and free the element 6*a*. Thereafter the member 8 is rocked back into the opposite direction as shown in FIG. 4 to lift up and free the other element 6*b*. Then the entire apparatus 6 can be lifted out of the recess 2, leaving the concrete body 3 ready to be handled by a pickup unit as described in my above-mentioned patents.

FIGS. 5 and 6 show how the arrangement can be modified slightly by cutting off the two elements 6*a* and 6*a'* at planes 22 that are perpendicular to the plane P and that converge somewhat downwardly, that is toward the anchor foot 5. This arrangement functions identically to that described above.

I claim:

1. An apparatus for forming in a concrete body during casting thereof a recess around the head of a pickup bolt having a stem inbedded in said body, said recess having a part-spherical inner surface, said apparatus comprising:

a pair of like elements each having an outer surface complementary to a respective half of said inner surface defined by a line bisecting said inner surface at said stem, said elements being formed with respective halves of a seat complementarily surrounding said bolt head and stem in said recess;

a bridge provided with a pair of pivots defining pivot axes parallel to said line, said elements being pivoted on said bridge element at said pivot axes; and a manipulating member connected to said bridge.

2. The apparatus defined in claim 1 wherein said inner surface is subdivided at a symmetry plane including said line and bisecting said head into the surface halves, said elements normally abutting at said plane and said axes symmetrically flanking said plane.

3. The apparatus defined in claim 2 wherein said elements form an upwardly open cutout snugly receiving said bolt head, said bridge substantially completely covering and blocking said cutout, whereby entry of concrete into said cutout is blocked by said bridge.

4. The apparatus defined in claim 3 wherein said bridge and elements have substantially coplanar upper surfaces perpendicular to said plane.

5. The apparatus defined in claim 3 wherein said outer surface of said elements are quarter-spherical.

6. The apparatus defined in claim 3 wherein each of said elements is a substantially solid piece of metal.

7. The apparatus defined in claim 3 wherein said manipulating member is a rod screwed into said bridge and normally lying on said plane.

8. The apparatus defined in claim 3 wherein said manipulating member is a rod rigidly connected to said bridge and normally lying on said plane.

9. The apparatus defined in claim 3 wherein said inner surface of said recess is defined by a pair of generally parallel said planes perpendicular to said symmetry plane and between said side planes by a portion of a spherical surface.

10. The apparatus defined in claim 9 wherein said side planes converge toward said head.

* * * * *